US005169086A

United States Patent [19]

Vesely

[11] Patent Number: 5,169,086

[45] Date of Patent: Dec. 8, 1992

[54] COLLAPSIBLE REEL FOR WIRE AND CABLE PACKAGING AND SYSTEM FOR STACKING AND TRANSPORTING THE SAME

[75] Inventor: Gordon F. Vesely, Menomonee Falls, Wis.

[73] Assignee: Reel Rotation, Inc., Menomonee Falls, Wis.

[21] Appl. No.: 671,197

[22] Filed: Mar. 18, 1991

[51] Int. Cl.[5] ..... B65H 75/22

[52] U.S. Cl. ..... 242/115

[58] Field of Search ..... 242/115, 77, 71.8, 71.9, 242/110, 110.1, 110.2, 110.3, 72 R

[56] References Cited

U.S. PATENT DOCUMENTS

| | | | |
|---|---|---|---|
| 1,742,584 | 1/1930 | Daubmeyer et al. | 242/115 |
| 1,913,477 | 6/1933 | Daubmeyer et al. | 242/115 X |
| 2,909,340 | 10/1959 | Whitaker | 242/115 |
| 3,791,606 | 2/1974 | Brown | 242/115 |
| 4,744,528 | 5/1988 | Winters | 242/71.8 |

FOREIGN PATENT DOCUMENTS

| | | | |
|---|---|---|---|
| 3536555 | 4/1987 | Fed. Rep. of Germany . | |
| 366509 | 2/1932 | United Kingdom | 242/115 |
| 467787 | 6/1937 | United Kingdom | 242/115 |

*Primary Examiner*—John M. Jillions
*Attorney, Agent, or Firm*—L. Vande Zande

[57] ABSTRACT

A pair of disc-shaped flanges having centrally located arbor holes defining an axis for the reel are axially spaced by a plurality of collapsible strut assemblies affixed to the flanges at opposite ends and split at their mid-portion, joined at such split by a lost motion pivotal connection. Hinges are provided the strut assemblies proximate the flanges to provide an articulated assembly which folds radially outward. Clamping means adjacent the hinges hold the assembly rigid in an empty but extended position of the reel. Bolts are provided between the flanges to lock the reel in a collapsed condition. A transportation fixture comprises an upright spindle on a platform over which the collapsed reels are stacked, arbor holes of the reels receiving the spindle. Securing means clamps the stack of collapsed reels to the platform.

16 Claims, 6 Drawing Sheets

2
4
14
3
18
12
18
14
18
10
18
16
18
18
18
6
8
26
18
18
26
4
58
6
58
8
10
3

4
58
42
58
8
2
38
26
38
38
42
42
26
42
26
58
24
58
24
58
4
8

8
4
10
6
48
68
50
72
70
46
58
50
32
56
30
34
22
24
18
26
28
42
44
28
38
22
24
26
34
56
30
46
32
50
58
70
4
10
6
8
72
50
68

6
48
68
50
52
46
10
72
58
70
66
64
50
60
52
56
32
54
30
34
26
24

10
6
50
68
72
70
48
60
62
48
50
64
60
58
62
66
66
54
52
32
30
52
34
26
24
24

COLLAPSIBLE REEL FOR WIRE AND CABLE PACKAGING AND SYSTEM FOR STACKING AND TRANSPORTING THE SAME

BACKGROUND OF THE INVENTION

The invention relates to reels for wire, cable and like materials. More particularly the invention relates to reels of the aforementioned type which are intended for re-use. Still more particularly the invention relates to reels of the aforementioned type which are collapsible when empty to reduce the overall size thereof for transportation and storage. The invention further relates to a system for stacking and transporting reels of the aforementioned type.

Wire and cable and similar strand materials are wound on relatively large reels by manufacturers of such products for shipment to purchasers and for dispensing by the purchaser. Such reels are provided with axial holes for mounting on the arbor of reel handling apparatus whereby the strand material can be unwound from the reel as required. When empty, the purchaser of the strand material is faced with either disposing of the reel in the case of non-returnable reels or shipping the empty reels back to the manufacturer of the strand material product. In some cases, brokers of such reels are available to buy and resell the empty reels, introducing an extra cost burden in the strand material product market. Use of non-returnable reels is further being hampered by landfill regulations which, in the very near future will no longer permit acceptance of the wood, steel, plastic, or other material from which such reels are constructed. The empty reels are not economically shipped because their volume is significantly greater than their weight, thereby prohibiting an economical weightload on a truck or other transportation mode. Moreover, both the manufacturer and purchaser of the strand material product are faced with significant storage space problems when quantities of such reels are collected.

A collapsible reel for the aforementioned purpose is known from German published patent application DE 3536555A1, published Apr. 23, 1987. This reel comprises a pair of disc-shaped flanges joined together by a plurality of winding supports which are hinged to the respective flanges at their opposite ends and are separated and hinged at their mid-length. The winding supports are arranged in a circle about the axis of the reel, extending parallel to the reel axis to form a drum in their extended condition. The hinging system renders the winding supports articulated for folding when the reel is empty to permit the flanges to be folded substantially together to reduce the axial dimension of the empty reel. Tension springs are provided to resist the folding action, thereby to dampen the collapse of the reel. The patent contemplates that in certain combinations of drum transverse (axial) width, drum diameter and flange diameter, the folded winding supports may protrude beyond the outer diameter of the flanges. It proposes that such condition may be prevented by causing the winding supports to fold normally to a radial dimension of the reel, but suggests that such construction may require a reinforcement or locking mechanism. Such contemplated construction is not shown or described in the patent. Instead, it discloses an alternate embodiment wherein the winding supports are foldable obliquely outward. Although such reel is satisfactory for its intended purpose, this invention relates to improvements thereover.

SUMMARY OF THE INVENTION

This invention provides a collapsible reel for wire and cable packaging which is clamped in a rigid extended condition and is releasable to permit the reel to be folded to a collapsed condition. The reel comprises a plurality of collapsible strut assemblies arranged in a circle and extending parallel to an axis of the reel between a pair of axially spaced disc-shaped flanges. The strut assemblies each comprise outer hinge support assemblies affixed to respective flanges and a pair of equal length sections hingedly connected to the hinge support assemblies and pivotally connected at their adjacent ends intermediate the flanges by a lost motion joint which facilitates folding. A clamp mechanism is provided at each hinge support assembly of at least one of the strut assemblies to engage the respective adjacent equal length section, rigidly clamping the strut assembly to an extended condition. The hinge support assemblies are provided in selected lengths to provide reels of different transverse (axial) widths. Locking means are also provided for locking the reel in a collapsed condition, facilitating handling thereof in that condition. The strut assemblies are constructed to fold radially outward, but not to protrude beyond the outer diameter of the flanges. A stacking fixture is provided for assembling a plurality of the collapsed reels in a secure, unitary manner for handling during transportation and storage.

These and other features and advantages of the collapsible reel of this invention will become more readily apparent and understood when reading the following description in conjunction with the accompanying drawings.

DETAILED DESCRIPTION OF THE PREFERRED EMBODIMENT

Figure 1:
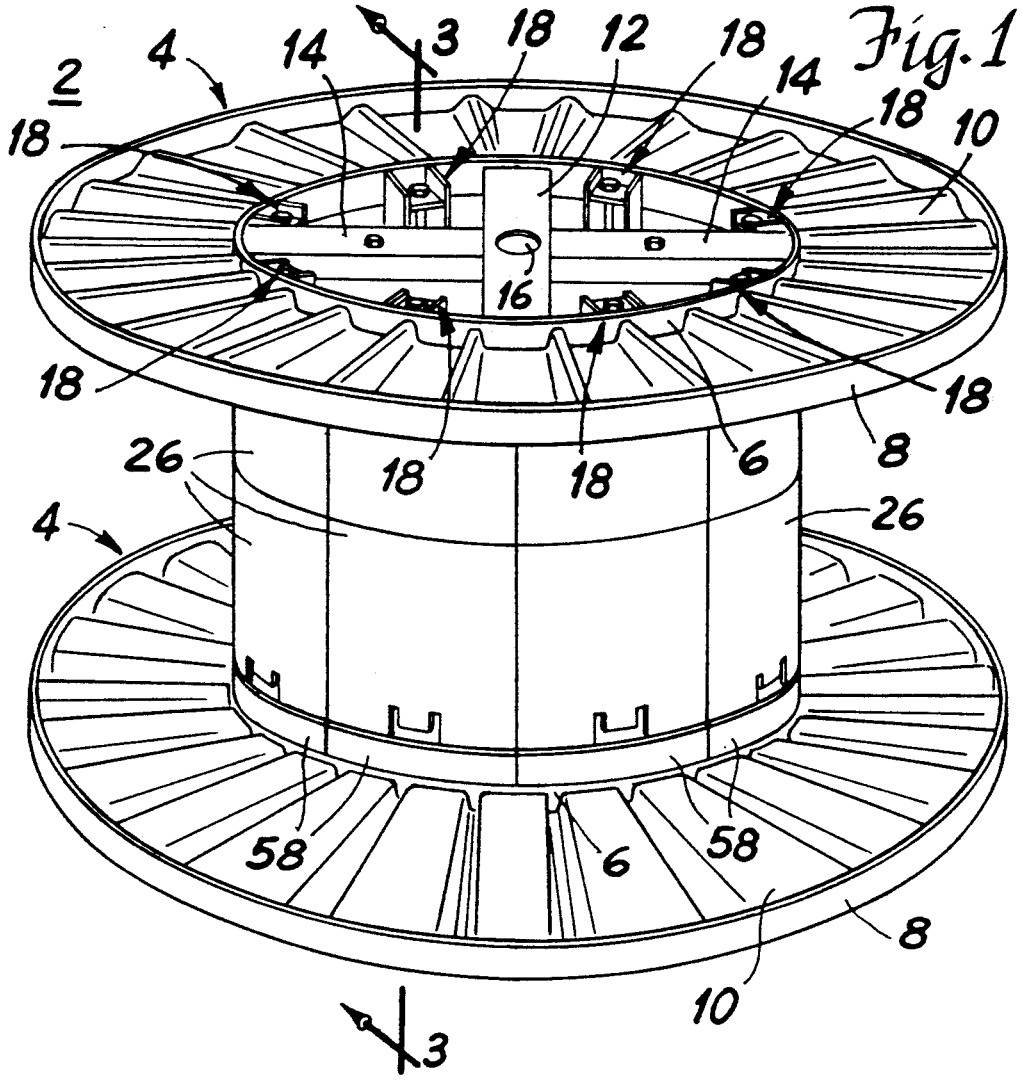
FIG. 1 is a perspective view of the collapsible reel of this invention shown in an extended condition, laying on one flange with the reel axis oriented vertically.

Referring particularly to FIG. 1 of the drawings, the collapsible reel 2 of this invention is shown resting on one side with its axis disposed vertically. In accordance with terminology of National Electrical Manufacturers Association (NEMA) standards for wire and cable packaging, reel 2 comprises a pair of flanges 4 having a cylindrical inner ring 6 and a cylindrical tire 8 joined by a fluted or corrugated head sheet 10. These members are preferably steel fabricated by welding, although other methods of forming and fabricating could be used. Thus, reference to "welded" construction throughout this description are to be understood to be exemplary and not limiting, in the method of practicing this invention. A hub comprising a long cross arm channel 12 and two short cross arm channels 14 are welded together at right angles to form a cross and are welded within the respective inner ring 6. An arbor hole 16 is formed in each long cross arm 12 concentric with the axis of the reel. For standard, non-collapsible reels, a cylindrical drum is formed as an integral part of the inner ring or is affixed thereto to extend axially between the flanges 4 concentric with the reel axis. The collapsible feature of this invention is capable of being retrofit to existing reels by cutting the flanges and drum apart adjacent to each flange. This feature is also intended for new construction.

Figure 3:
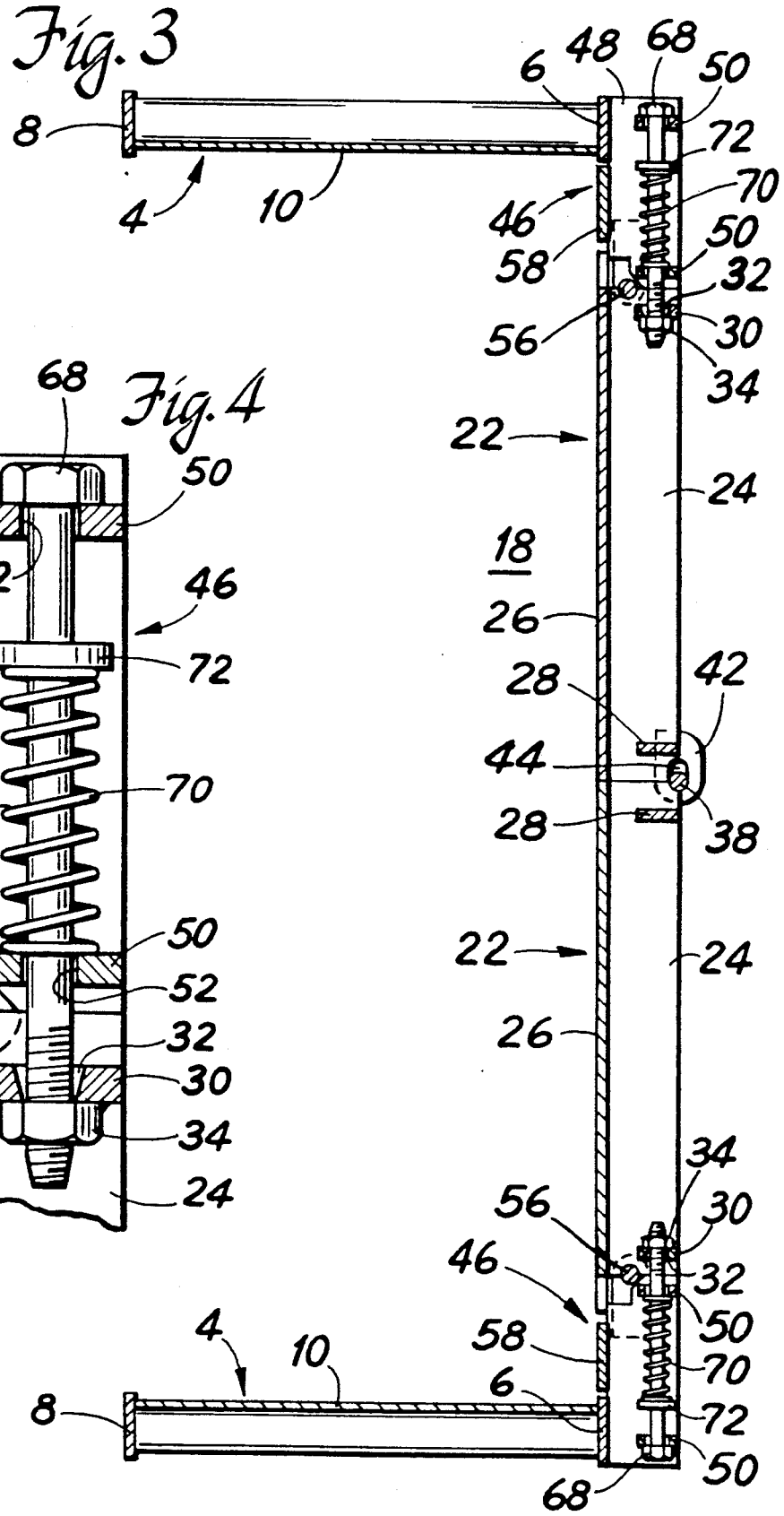
FIG. 3 is a sectional view through a collapsible strut assembly and the opposite flanges of the collapsible reel of this invention taken along the line 3—3 in FIG. 1.
Figure 5:
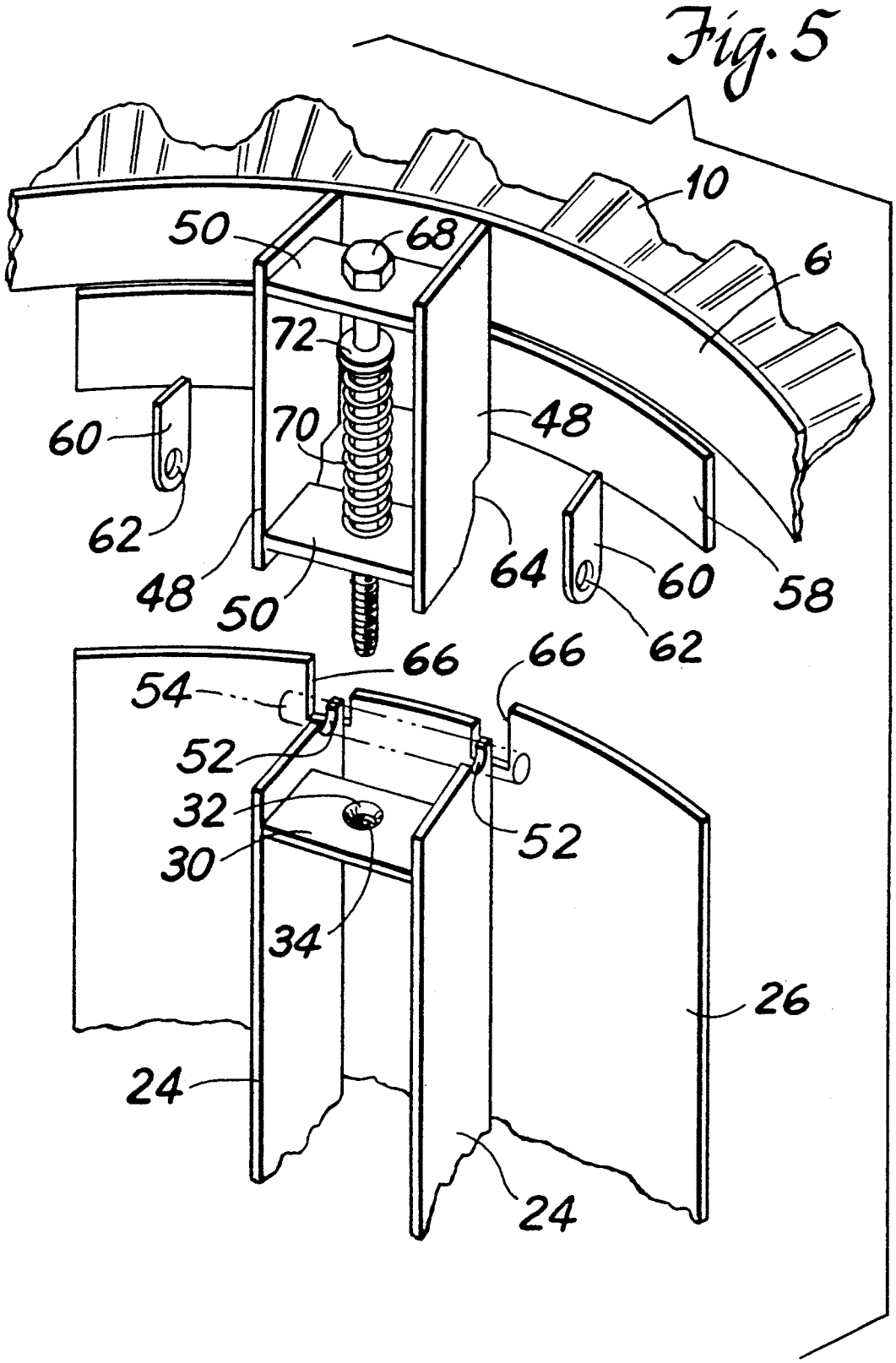
FIG. 5 is an exploded perspective view of a hinge support assembly, clamping mechanism, a fragment of a flange and a section of a strut assembly.
Figure 6:
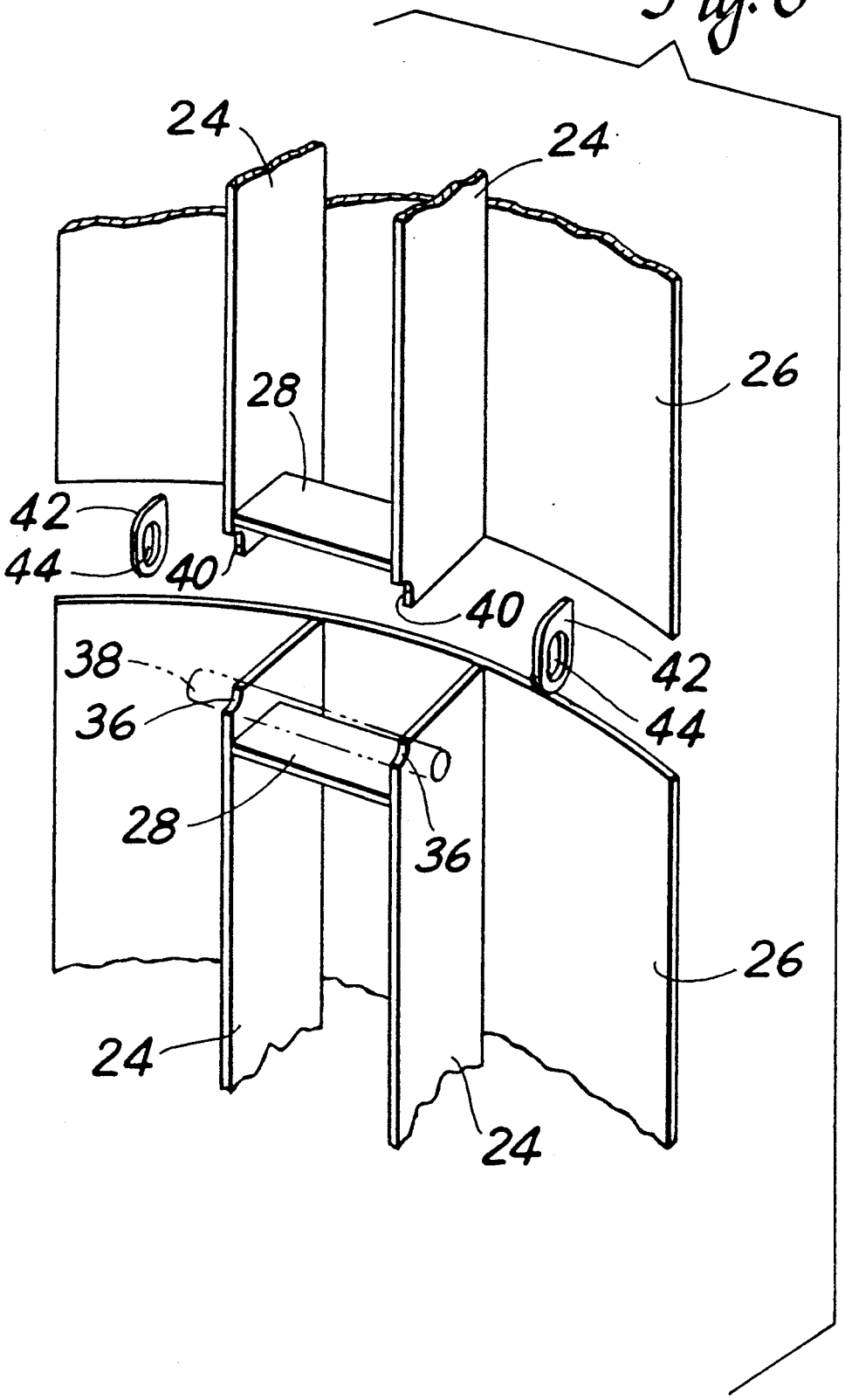
FIG. 6 is an exploded perspective view of a pivotal connection for adjacent ends of two sections of a strut assembly.

The drum of the reel 2 of this invention comprises a plurality of collapsible strut assemblies 18. Preferably, eight such strut assemblies 18 are employed to form a continuous drum surface 20 and a uniform arcuate spacing around the reel axis. However, other numbers of such strut assemblies in odd or even quantities are also contemplated. One collapsible strut assembly 18 is shown in enlarged cross-section in FIG. 3, together with segments of the opposite flanges 4. Strut assembly 18 comprises a pair of equal length sections 22 which are approximately the length of the radial dimension of a flange 4 between inner ring 6 and tire 8. Sections 22 comprise a pair of plates 24 (see also FIG. 6) welded to an arcuate drum segment plate 26 in parallel spaced relation. Channels or box tube members could also be used instead of plates 24, but the plates are preferred for reduction in material and weight. Cross brace members 28 and 30 are welded between the plates 24 proximate the opposite ends. Frusto-conical holes 32 are provided in plates 30 (FIG. 5) and a threaded nut 34 is welded to the surface of plate 30 facing the transverse center of the reel in alignment with hole 32. With respect to the orientation of FIG. 3, the upper radial inward corners of plates 24 of lower section 22 have quarter circle notches 36 (FIG. 6) formed therein into which a pin 38 is welded. The upper section 22 is provided with elongated notches 40 generally complementally located with respect to notches 36. The upper and lower sections are interconnected by members 42 having elongated slots 44 therein disposed over projecting ends of pin 38 and welded to the lateral sides of plates 24 of the upper section 22, fixing the members 42 offset from the plane of plates 24 to enable adjacent ends of the respective aligned plates to meet in abutting relationship. Thus, the sections 22 are joined at a lost motion pivotal connection at their adjacent ends for reasons that will be more fully explained hereinafter.

Figure 4:
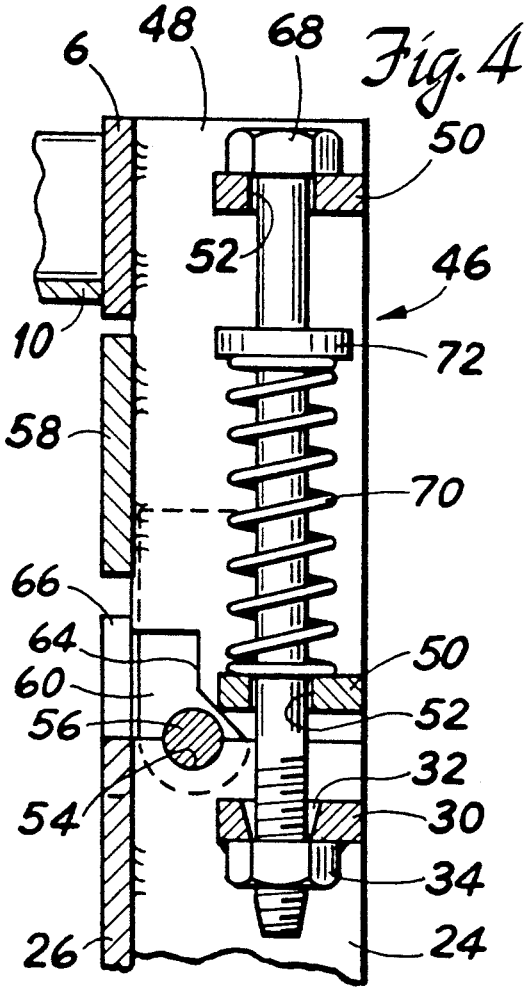
FIG. 4 is a cross sectional view of a hinge support assembly and clamping mechanism of one end of the strut assembly of FIG. 3, drawn to an enlarged scale.

Strut assembly 18 also comprises a pair of hinge support assemblies 46 located at the respective ends of sections 22 opposite the pivotal connection. One hinge support assembly 46 is best shown in enlarged view FIG. 4 and in perspective view FIG. 5. Each assembly 46 comprises a pair of spaced parallel plates 48 separated by cross braces 50 welded therebetween. Braces 50 have holes 52 formed therethrough. The length of plates 48 is predetermined in accordance with the required transverse (axial) width of the drum portion of reel 2.

As mentioned hereinabove, length of sections 22 is related to the flange radial width. Therefore, variations in the transverse width of the drum are primarily accomplished by varying the length of plates 48, although the diameters of the drum and flange are also factors that determine such length. The important factor is that the length of sections 22 is such that the outer ends do not project beyond the outer diameter of flanges 4 in the collapsed condition of the reel as will become more apparent hereinafter. Plates 48 are spaced to be disposed in coextensive alignment with plates 24 of sections 22 such that the edges thereof adjacent the respective sections 22 are in abutting relationship therewith in final assembly. Referring again to sections 22, the respective end of each which is adjacent a respective hinge support assembly 46 is provided with semi-circular notches 54 in each plate 24. A pin 56 is positioned transversely of plates 24 within the notches 54 and is welded to the plates 24. An arcuate plate 58 correspondingly shaped to plate 26 is welded to plates 48. The axial length of plate 58 is predetermined in correspondence to the predetermined length of plates 48 to provide a filler drum surface segment. The hinge support assembly is joined to the respective section 22 by members 60 having holes 62 therein which are disposed over the projecting ends of pin 56 and welded to the lateral surfaces of the respective plates 48, offset from the plane of plates 48 and 24. As seen in the drawings, the ends of plates 48 adjacent section 22 are relieved at 64 to provide clearance for pin 56 and for section 22 when the latter is folded to a collapsed condition as will be described hereinafter. Additionally, plate 26 of section 22 is notched at 66 to provide clearance for plates 48 and members 60. Strut assemblies 18 are affixed to flanges 4, preferably by welding the outer edges of plates 48 to the inner surface of inner ring 6.

A clamping mechanism is provided in the hinge support assembly 46 to rigidly clamp the adjacent section 22 to the hinge support assembly in an extended position. The clamping mechanism may be a quick release toggle mechanism or other suitable device, but is contemplated in this preferred embodiment to be a spring biased bolt 68 extending through holes 52 in braces 50 parallel to the axis of the reel. A helical compression spring 70 is disposed between one of the braces 50 and a washer 72 tack welded to the shank of bolt 68, biasing the bolt away from the adjacent section 22. The projecting distal end of bolt 68 is threaded and tapered to a reduced diameter to readily be received through frusto-conical hole 32 in member 30 and to enter the threaded hole of nut 34. It is preferred that the thread of bolt 68 and nut 34 be a square Acme-type thread or the like for quick, minimal rotation engagement. Screw 68 is disposed radially inward of pin 56 to draw the plates 48 and 24 tightly together in abutting relationship in the extended position of the reel. This motion also applies tension to the pivotal connection at the adjacent ends of sections 22 to firmly clamp this joint as well.

As shown in FIG. 1, each strut assembly 18 is preferably provided a clamping mechanism at each end. When extended and clamped at all hinge support assemblies, the reel is a rigid member, capable of being handled without resilient "give" or instability. It is contemplated, however, that not all strut assemblies necessarily include a clamping mechanism. In fact, significant rigidity of the reel is accomplished by engaging the clamping mechanisms of only one strut assembly. The extended, clamped reel has a rated weight capacity equal to its non-collapsible counterparts.

Figure 2:
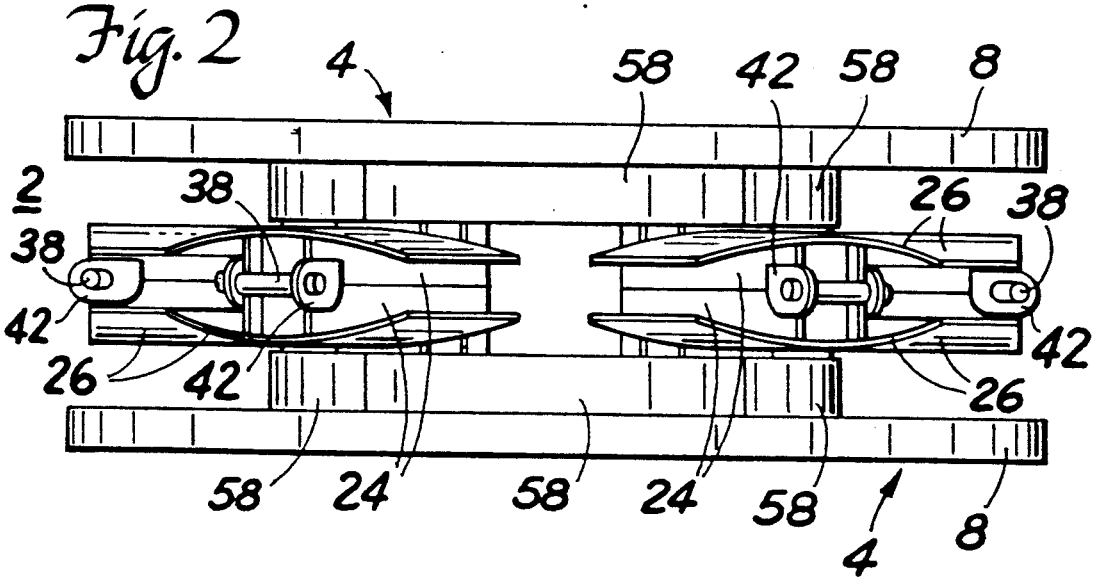
FIG. 2 is a side elevational view of the reel of FIG. 1 shown in a collapsed condition.
Figure 7:
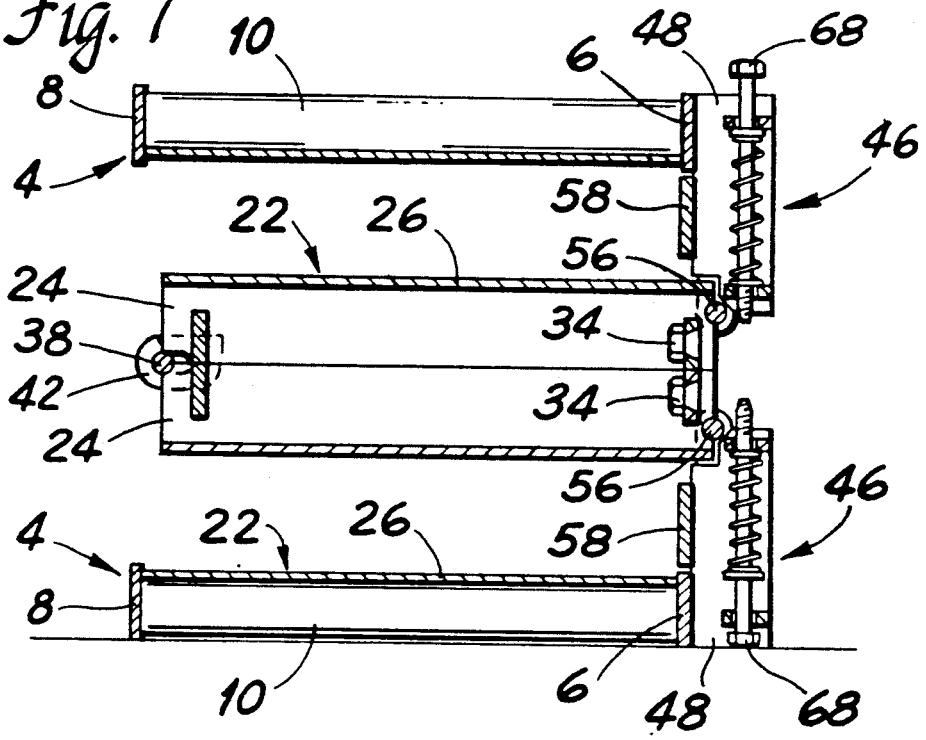
FIG. 7 is a cross-sectional view of the strut assembly as shown in FIG. 3, but shown in a collapsed condition.

When desired to fold the reel to a collapsed condition as shown in FIG. 2, the clamping mechanisms on one side of the reel, i.e. at one flange, are released by turning bolts 68 until free of nuts 34 whereupon springs 70 bias the bolts away from sections 22. Reel 2 is then inverted and the bolts 68 on the other side are turned free of nuts 34 to free the entire assembly. The reel will remain extended by virtue of the abutting engagement of the plates 24 and 48. However, by grasping the upper flange 4 and imparting a motion thereto, such as a rotational or lateral motion, the strut assemblies will fold radially outwardly at the pivot connections at pins 38. Slot 44 greatly enhances this folding over the fixed hinge of the prior art inasmuch as the hinge axis of pins 38 and 56 are not in alignment. Thus, for pin 38 to swing radially outward with respect to the reel axis, it must move through the imaginary line between pins 56. Plane geometry will show that such is not a straight line motion, but an arcuate motion which has a vertical component of displacement, however small. Such displacement will cause pinching in a fixed pivot hinge, breaking suddenly over center as elastic deformation occurs within the hinge. Ultimately such deformation can cause fatigue and rupture of the hinge. The slot 44 provides for necessary displacement of pin 38 as the assembly folds smoothly to collapsed condition. Referring particularly to FIG. 7, it can be seen that the ends of sections 22 rotate into relieved portions 64 of the hinge support assemblies 46. The previously radial inward edges of plates 24 come to rest parallel on each other to firmly support the reel in the collapsed condition. It will also be noted in FIG. 7 that the outer ends of sections 22, and members 42, are fully within the outer boundary of the reel defined by the outer diameter of flanges 4. This is a safety feature to workmen collapsing the reel, as well as permitting the collapsed reel to be moved by rolling it on the flanges if desired, protecting the collapsed reel and its strut assemblies from damage which could result in misalignment of elements in later usage, or prevent later extension or clamping of the reel.

Figure 8:
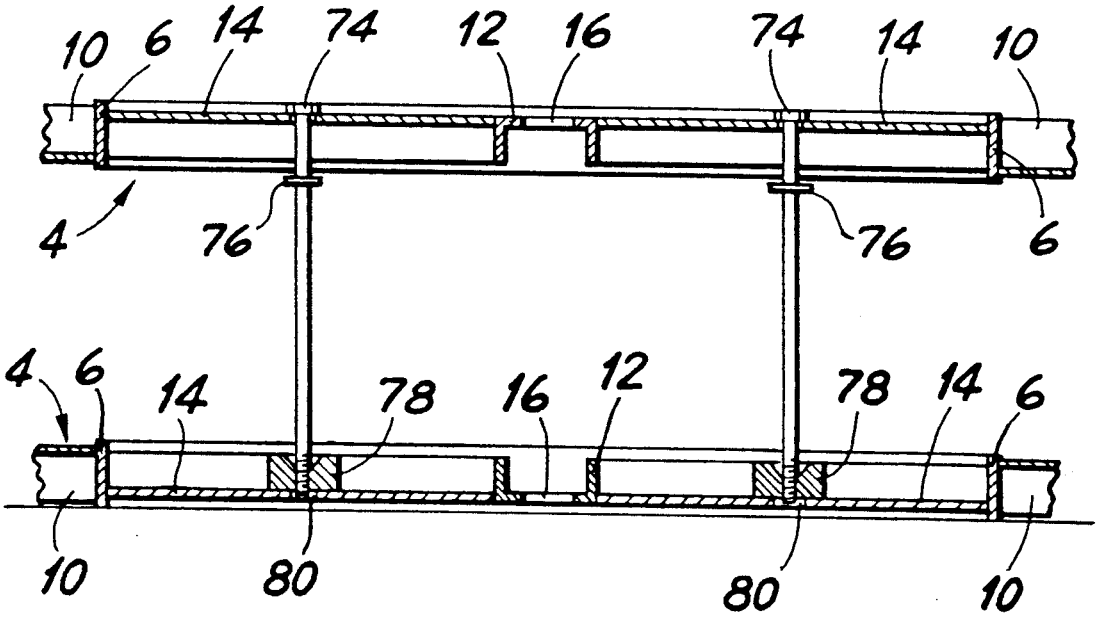
FIG. 8 is a cross-sectional view of a central hub portion of the reel of this invention shown in a collapsed condition and locked in such position by locking means.

FIG. 8 shows a locking means for locking the reel in the collapsed condition. A pair of long bolts 74 are captively rotatably retained in holes provided in short cross arms 14 by washers 76 tack welded to bolts 74 on the shanks thereof. A pair of threaded blocks 78 are secured to the inside of short cross arms 14 on the opposite flange 4 over holes 80 in the cross arms. The threaded blocks 78 are provided with widely countersunk lead-in holes to assist in aligning bolts 74. By turning bolts 74 into the threaded blocks 78, the reel 2 is securely locked in its collapsed condition and may be easily handled.

Figure 9:
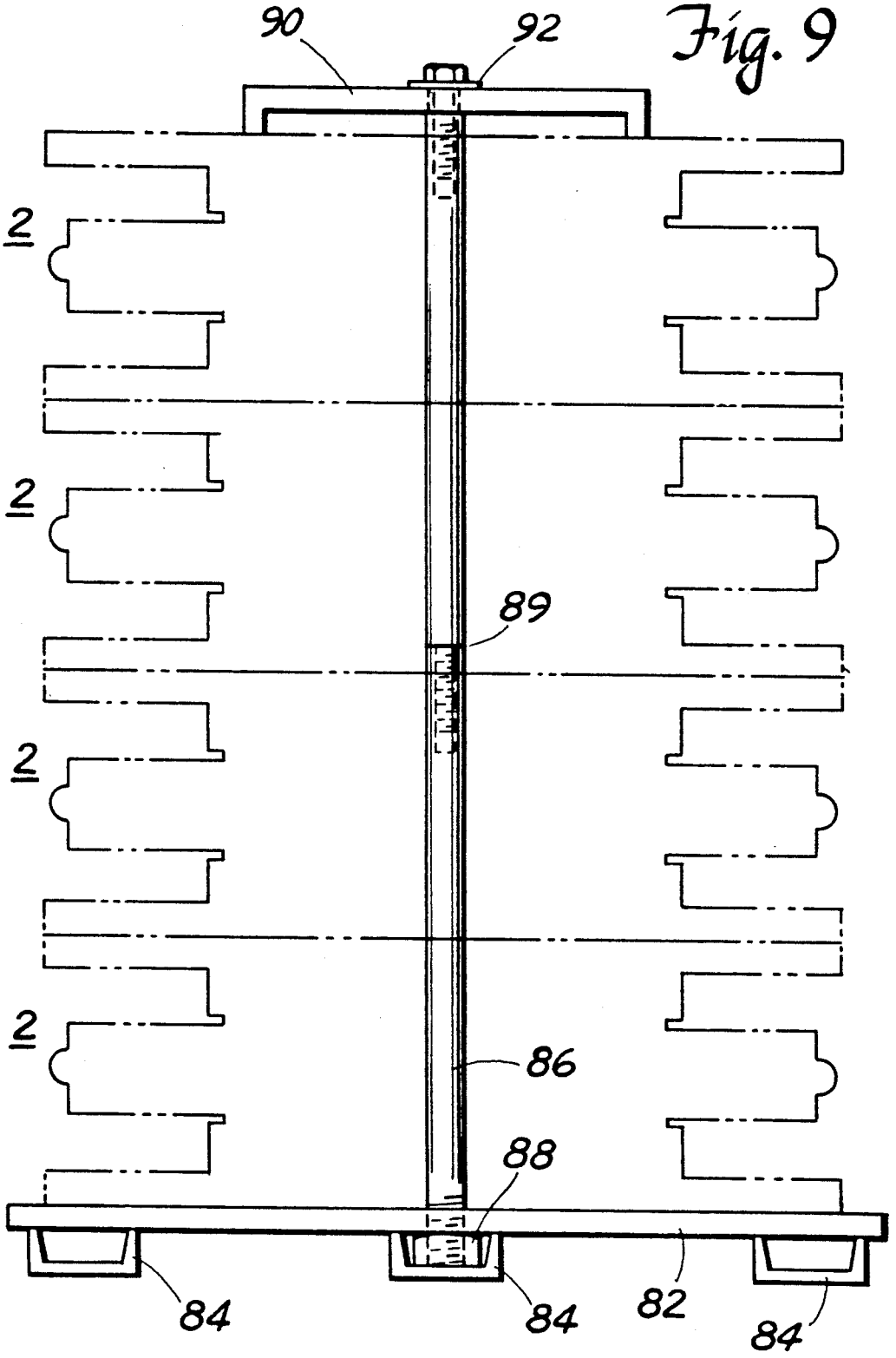
FIG. 9 is a side elevational view of a stacking fixture positioning and securing a plurality of collapsed reels of this invention in a unitary packing for transportation.

The invention further contemplates a storage and transportation system for the reels as shown in FIG. 9. A support plate 82 has channels 84 welded to its underside to form a pallet-like structure for handling by a fork lift hoist apparatus or the like. A spindle 86 is secured upright to the center of the support plate 82 such as by threading it into a hole in the plate. For additional stability, a threaded block 88, which may be a conventional pipe coupling, may be secured within the center channel 84. Collapsed reels 2, shown in broken outline, are stacked over the spindle 86 with their arbor holes 16 disposed around the spindle. Conversely, the spindle may be inserted through the arbor holes and threaded to the base plate subsequent to stacking the collapsed reels on the base plate. To accommodate different reel sizes and quantities of reels, spindle 88 may be sectionalized by threaded joints as show at 89. The plurality of reels 2 may be secured to the plate 82 by conventional strapping methods, or by bolting a cap 90 to the upper end of spindle 86, compressing the assembled stack. A Belleville washer 92 may also be provided to provide clamping pressure.

The foregoing has described an improved collapsible reel for cable and wire packaging which is rigid in its extended condition, even while empty, and is readily collapsible by releasing clamping means and imparting a motion to an upper flange when oriented on one flange. The collapsed reel may be locked in the collapsed condition for ease in handling, and may be stacked on a transportation fixture with additional collapsed reels for a unitary shipping assembly. Although a preferred embodiment has been shown and described herein, it is to be understood that the invention is susceptible of various modifications without departing from the scope of the appended claims.

I claim:

1. A collapsible reel for wire and cable packaging comprising:

a pair of disc-shaped flanges spaced along an axis of said reel;

a plurality of collapsible strut assemblies connected at opposite ends thereof to respective said flanges, said strut assemblies being arranged parallel to said reel axis at equal radial distances from said reel axis, forming a drum between said flanges;

each said strut assembly comprising a pair of equal length sections joined at a pivotal connection intermediate said flanges, said pivotal connection comprising a pin on one of said sections received in slots elongated parallel to said reel axis in the other of said sections, each said strut assembly section further comprising a hinged connection proximate a respective said flange, said hinged connection comprising a hinge support assembly affixed to said respective said flange in co-extensive alignment with a respective adjacent said section, a pin on one of said hinge support assembly or said section received in holes in the other of said hinge support assembly or said section establishing a hinge axis, said sections being pivotable about said hinged connections carrying said pivotal connection radially outward of said reel axis to collapse said reel; and clamping means at each hinged connection on at least one of said strut assemblies, said clamping means being located radially inward of said hinge axis relative to said reel axis, clamping said section and said hinge support assembly together in abutting engagement in an extended position of said strut assembly.

2. The collapsible reel of claim 1 wherein said clamping means comprises a bolt rotatably carried by said hinge support assembly threadably engagable with cooperatively threaded means on said adjacent section axially aligned with said bolt in said extended position of said strut assembly.

3. The collapsible reel of claim 2 wherein said bolt is disposed axially parallel to said reel axis.

4. The collapsible reel of claim 2 wherein said bolt is biased away from engagement with said cooperatively threaded means.

5. The collapsible reel of claim 1 wherein said holes are disposed in members affixed to sides of one of said hinge support assembly or said adjacent section, said members locating said holes laterally offset from a plane containing said hinge support assembly and said adjacent section.

6. The collapsible reel of claim 1 wherein said elongated slots are disposed in members affixed to sides of said other of said sections, said members locating said slots laterally offset from a plane containing said sections.

7. The collapsible reel of claim 1 wherein said sections each comprise an arcuate plate at a radially outboard edge of said section relative to said reel axis, said arcuate plate being curved concentrically about said reel axis, forming a drum surface segment.

8. The collapsible reel of claim 7 wherein said strut assemblies are arranged at equal angular positions relative to said reel axis and edges of adjacent said arcuate plates parallel to said reel axis are contiguous in said extended position.

9. The collapsible reel of claim 8 wherein a chord height of a respective arcuate plate is equal to or less than an overall height of a respective section measured radially from said reel axis.

10. The collapsible reel of claim 8 comprising eight said strut assemblies.

11. The collapsible reel of claim 7 wherein each said hinge support assembly comprises an arcuate plate at a radially outboard edge of said hinge support assembly relative to said reel axis, said plate being curved concentrically about said reel axis, forming a drum surface segment coextensively aligned with said arcuate plate of a respective adjacent said section.

12. The collapsible reel of claim 1 wherein said sections have a length equal to or less than a radial dimension between said drum and an outer diameter of said flange.

13. The collapsible reel of claim 12 wherein an axial dimension of said reel greater than twice said radial dimension between said drum and an outer diameter of said flanges is attained by said hinge support assemblies having a selected predetermined axial length between said respective flange and said hinge axis.

14. The collapsible reel of claim 1 wherein ends of said sections joined by said pivotal connection are concentric with or radially inboard of an outer diameter of said flanges in a collapsed position of said reel.

15. The collapsible reel of claim 1 comprising locking means carried by one of said flanges cooperatively engagable with means on the other of said flanges in a collapsed position of said reel for locking said reel collapsed.

16. The collapsible reel of claim 15 wherein said locking means comprises a bolt captively mounted to said one flange radially inwardly of said strut assemblies and extending parallel to said reel axis, and said means on said other of said flanges comprises a cooperatively threaded opening for receiving said bolt.

* * * * *